United States Patent [19]

Svagr et al.

[11] Patent Number: 5,038,594

[45] Date of Patent: Aug. 13, 1991

[54] ARRANGEMENT FOR GUIDING ROLLED MATERIAL BETWEEN THE ROLLS OF ROLL STANDS

[75] Inventors: Alexander Svagr, Hilden; Ingo Jaki, Duisburg; Hans-Jürgen Reismann, Düsseldorf; Karl-Heinz Spillner, Neuss, all of Fed. Rep. of Germany

[73] Assignee: SMS Schloemann-Siemag Aktiengesellschaft, Dusseldorf, Fed. Rep. of Germany

[21] Appl. No.: 438,348

[22] Filed: Nov. 16, 1989

[30] Foreign Application Priority Data

Nov. 16, 1988 [DE] Fed. Rep. of Germany ..... 3838764

[51] Int. Cl.[5] ..... B21B 39/16

[52] U.S. Cl. ..... 72/250; 72/428

[58] Field of Search ..... 72/227, 238, 250, 251, 72/428; 226/196, 197, 198, 199

[56] References Cited

U.S. PATENT DOCUMENTS

| | | | |
|---|---|---|---|
| 3,258,953 | 7/1966 | Hermes et al. | 72/250 |
| 3,438,236 | 4/1969 | Ogle et al. | 72/250 |
| 3,459,023 | 8/1969 | Adair | 72/238 |

FOREIGN PATENT DOCUMENTS

| | | | |
|---|---|---|---|
| 2129337 | 3/1973 | Fed. Rep. of Germany | 72/250 |
| 2356785 | 5/1975 | Fed. Rep. of Germany | 72/250 |
| 0085610 | 5/1982 | Japan | 72/238 |
| 1201431 | 8/1970 | United Kingdom | 72/250 |

*Primary Examiner*—Lowell A. Larson
*Assistant Examiner*—Thomas C. Schoeffler
*Attorney, Agent, or Firm*—Toren, McGeady & Associates

[57] ABSTRACT

An arrangement for guiding rolled material, particularly section steel, between the rolls of a rolling mill stand. The arrangement includes support beams which are located transversely of the rolling direction above and below the pitch line. The support beams are mounted on pairs of housing posts so as to be vertically movable and driven by a lifting motor. Support members for guide elements of a pair of guide elements for the rolled material are connected to the support beams so as to be pivotable, adjustable and fixable. Each support member of the guide elements is arranged on an independent additional support beam connected to the pair of housing posts. The additional support beam is exchangeably and releasably connectible and fixable to the support beam.

1 Claim, 2 Drawing Sheets

ARRANGEMENT FOR GUIDING ROLLED MATERIAL BETWEEN THE ROLLS OF ROLL STANDS

BACKGROUND OF THE INVENTION

1. Field of the Invention

The present invention relates to an arrangement for feeding-in and feeding-out rolled material, particularly section steel, between the rolls of rolling mill stands. The arrangement includes support beams which are located transversely of the rolling direction above and below the pitch line. The support beams are mounted on pairs of housing posts so as to be vertically movable and driven by a lifting motor. Support members of guide elements of a pair of guide elements for the rolled material are connected to the support beams so as to be pivotable, adjustable and fixable.

2. Description of the Related Art

Arrangements of the above-described type have the purpose to change and adjust the positions of the two guide elements independently of each other, for example, for improving the symmetrical centering of the web of a girder to be rolled, wherein the guide elements act on the web and guide it between the rolls of a rolling mill stand.

In an arrangement known from Japanese published application 38,762, support members of the guide elements are vertically movably guided in the threads of lifting screws which extend perpendicularly to the rolling plane and are supported on the outside of the pairs of housing posts of the rolling mill stand. The housing screws are driven by a common motor through screw gearings which are also mounted on the housing posts. The guide elements are pivotable in the respective support about pivoting axes which extend parallel to the roll axes. The pivoting positions of the guide elements arranged above the rolling plane are effected by means of a lifting motor which is also arranged on the housing post and is connected to the guide elements between the pivoting axis and the rolls. The guide elements located below the rolling plane rest with their feeding-in end on the outer circumference of the lower roll.

The arrangement of the above-described type has the disadvantage that the adjustment of the guide elements must be carried out prior to the beginning of the rolling operation when the guide elements are already mounted on the rolling mill stand. In other words, the rolling operation can only be commenced after the adjustment of the guide elements has been concluded. The same is true for the replacement of the guide elements for changing the rolling program. These adjustment operations of the rolling mill stand are difficult and time-consuming because it is frequently necessary also to disassemble components which are arranged on the rolling mill stand but are not part of the arrangement for feeding in the rolled material, and because the use of auxiliary arrangements for adjustment is made difficult or even impossible by the adjustment operations within the rolling mill train.

It is, therefore, the primary object of the present invention to provide an arrangement of the above-described type in which the difficulties and disadvantages described above are avoided. Specifically, idle times of the rolling mill stands occurring during the adjustment of the guide elements and the replacement thereof are to be reduced.

SUMMARY OF THE INVENTION

In accordance with the present invention, each support member of the guide elements is arranged on an independent additional support beam which is exchangeably and releasably connectible and fixable to the support beam connected to the pair of housing posts.

The arrangement according to the present invention makes it possible to mount and adjust the guide elements on the additional support beam outside of the rolling mill train at an assembly location specifically equipped for this purpose, before the guide elements are connected together with the additional support beam to the rolling mill stand. Thus, an additional support beam already mounted on the stand can be exchanged for an additional support beam which is equipped with adjusted guide elements. Such an exchange, for example, required for a change in the rolling program, requires less time and fewer assembly steps of the rolling mill stand as compared to the time required in known arrangements and the assembly difficulties of known arrangements.

In accordance with a useful feature of the present invention, the support beam receiving the additional support beam is slidably guided with its two ends in guide grooves of the housing posts. The additional support beam is mounted on the side of the support beam facing away from the rolls of the rolling mill stand and is placed on the support beam by means of bolts which are inserted in sleeves.

In accordance with another feature of the present invention, the bolts may be arranged on the additional support beam and may have a cantilever extension on the side facing away from the support beam, wherein the support members of the guide elements have corresponding receiving recesses and are mountable on the cantilever extension.

Another advantageous feature provides that the support beam has a bulging portion which extends in the direction toward the rolls of the rolling mill stand and between the housing posts, wherein the bulging portion completely or partially encloses the additional support beam at a distance therefrom. As a result, the structural depth of both support beams including the guide elements mounted on the additional support beam are kept small in relation to the arrangement thereof in the rolling mill stand.

Pressure-medium operated wedge-type clamping member may be arranged in the two ends of the support beam, wherein the wedge-type clamping members act in mounting direction of the support beam on contact surfaces at the ends of the additional support beam.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
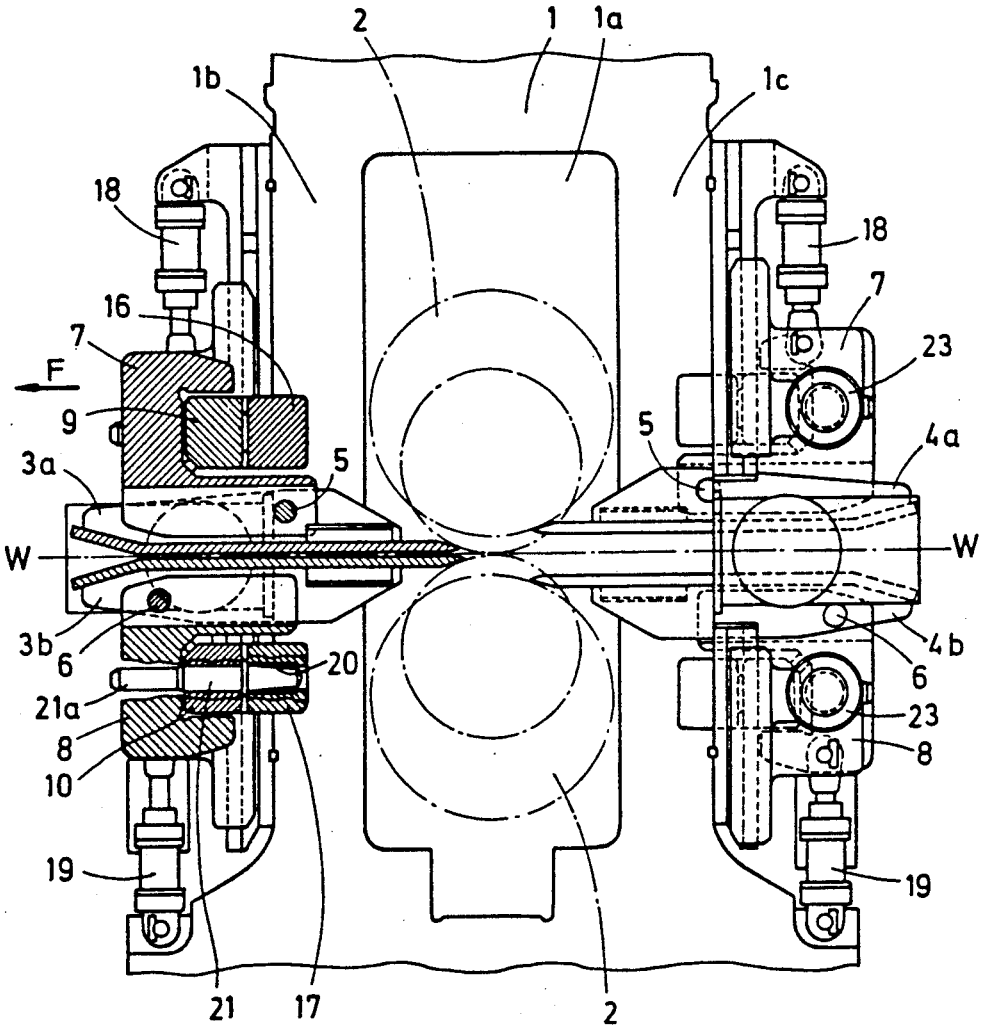
FIG. 1 is an elevational view, partially in section, of the arrangement according to the present invention.

As illustrated in FIG. 1, pairs of rolls 2 shown dash-dot lines are mounted in windows 1*a* of a rolling mill stand 1 and between the inner surfaces of pairs of housing posts 1*b* and 1*c*. The rolled material, not shown, is guided in and out between the rolls 2 by means of guide elements 3*a* and 3*b*, 4*a* and 4*b* which form a pair each. The pairs of guide rollers 3*a*, 3*b* and 4*a*, 4*b* are connected in an articulated manner to support members 7 and 8 which have a hook-shaped cross-section, through pivot axes 5, 6 which extend parallel to the roll axes. The support members 7 and 8, in turn, can be connected to additional support beams 9 and 10.

The additional support beams 9, 10 can be connected to support beams 16 and 17, respectively, which guided by means of T-shaped grooves 14 in the rolling mill stand 1 in T-shaped rails 15. The support beams 16 and 17 have bulging portions 16*a* and 17*a* which are open toward the side facing away from the rolls 2 and extend in direction toward the rolls 2 of the rolling mill stand 1 between the housing posts 1*b*, 1*c*. The ends 16*b* and 17*b* of the support beams 16 and 17 are connected to lifting motors 18 and 19 which, in turn, are connected to housing posts 1*b*, 1*c*.

In the illustrated embodiment, the connection of the additional support beams 9 and 10, on the one hand, to the support member 7, 8 of the guide elements 3*a*, 3*b* and, on the other hand, to the support beams 16, 17 is effected by means of a bolt 21 each mounted in the additional support beams 9 and 10. The bolt 21 is insertable in a sleeve 20 in support beam 16 or 17 and the bolt 21 has a cantilever extension 21*a* onto which the support member 7 or 8 of the guide elements 3*a* or 3*b* can be slid with corresponding receiving openings, not shown.

Figure 2:
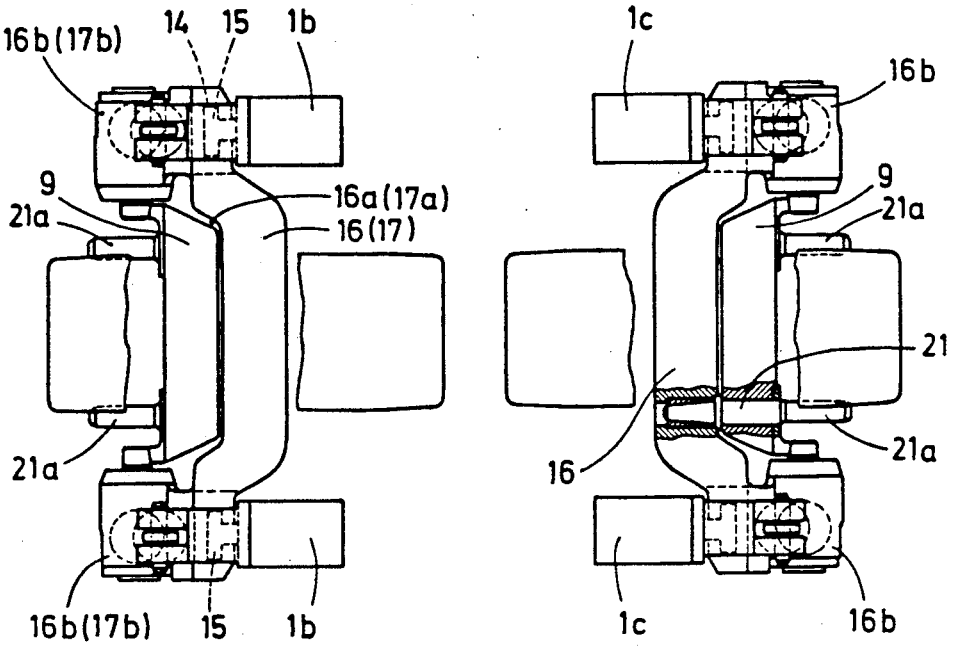
FIG. 2 is a top view of the arrangement of FIG. 1.
Figure 3:
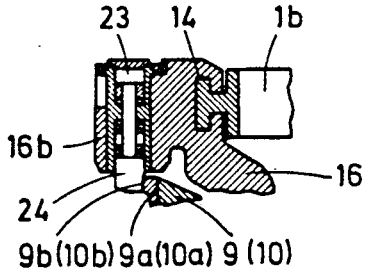
FIG. 3 is a sectional view of a detail of the view of FIG. 2.

As can be seen from FIG. 3 in connection with FIG. 2, wedge-type clamping members 24 are arranged at the two ends 16*b* and 17*b* of the support beams 16 and 17. Pressure medium-actuated motors 23 act on the wedge-type clamping members 24. The wedge-type clamping members 24 act on contact surfaces 9*b* and 10*b* provided at the ends 9*a* and 10*a* of the additional support beams 9 and 10.

As illustrated in FIG. 1, the support members 7, 8 with the guide elements 3*a*, 3*b* can be moved by actuating the lifting motors 18, 19, for example, from the position shown in the drawing in which the guide elements 3*a*, 3*b* are positioned a small distance above or below the pitch line W, into the position shown in solid lines in which the guide elements, i.e., 4*a*, 4*b*, have a greater distance from the pitch line W.

For replacing the additional support beams 9 and 10, the additional support beams 9 and 10 are pulled together with the support members 7 and 8 and the guide elements 3*a*, 3*b* in the direction of arrow F shown in FIG. 1 from the support beams 16 and 17 out of the sleeves 20. The additional support beams 9 and 10 are then transported to the assembly location. In the meantime, additional support beams 9, 10 already mounted at the assembly location with the support members 7, 8 and the already adjusted guide elements 3*a*, 3*b* are mounted on the support beams 16, 17 by means of bolts 21. The additional support beams 9 and 10 are separated from and fixed to the support beams 16 and 17 by means of the clamping levers or members 24.

While specific embodiment of the invention has been shown and described in detail to illustrate the application of the inventive principles, it will be understood that the invention may be embodied otherwise without departing from such principles.

We claim:

1. An exchangeable independent arrangement for supporting support members for guide elements for material to be rolled in a rolling direction between the rolls of a rolling mill stand, the stand defining a pitch line, the arrangement comprising:

support beams located transversely of the rolling direction above and below the pitch line, the support beams being mounted on pairs of housing posts so as to be vertically movable and driven by a lifting motor;

means for connecting the support members to the support beams so as to be pivotable, adjustable and fixable;

each support beams having two ends, guide grooves being provided in the support beams at the two ends thereof, each housing post having guide rails, the guide rails being guided in the guide groove;

each support member of the guide elements being mounted on an additional support beam;

each support beam having a bulging portion which extends in direction toward the rolls and between the housing posts, the bulging portion being open toward the additional support beam, the bulging portion at least partially enclosing the additional support beam at a distance therefrom;

the additional support beams being connected to the support beams by means of sleeve and bolt connections, such that each additional support beam is fixable on the support beam by sliding the additional support beam in a direction toward the rolling mill stand and the additional support beam is removable from the operating position by moving the additional support beam in a direction away from the rolling mill stand, wherein the bolts are arranged on the additional support beam;

each bolt having a cantilever extension on a side of the additional support beam facing away from the support beam, the support members of the guide elements for the material to be rolled having corresponding sleeves for receiving the cantilever extensions; and pressure medium-operated wedge-type clamping members mounted in the two ends of each support beam, wherein the wedge-type clamping members are mounted so as to act in mounting direction of the support beam on contact surfaces at the ends of the additional support beam.

* * * * *